US010417965B2

(12) United States Patent
Nakamura

(10) Patent No.: US 10,417,965 B2
(45) Date of Patent: Sep. 17, 2019

(54) ORGANIC EL DISPLAY DEVICE AND METHOD OF DRIVING AN ORGANIC EL DISPLAY DEVICE

(71) Applicant: Japan Display Inc., Minato-ku (JP)

(72) Inventor: Norio Nakamura, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 56 days.

(21) Appl. No.: 15/725,777

(22) Filed: Oct. 5, 2017

(65) Prior Publication Data

US 2018/0108299 A1 Apr. 19, 2018

(30) Foreign Application Priority Data

Oct. 13, 2016 (JP) ..... 2016-201585

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0842* (2013.01); *G09G 2300/0861* (2013.01); *G09G 2320/0233* (2013.01); *G09G 2320/0247* (2013.01); *G09G 2320/064* (2013.01); *G09G 2330/021* (2013.01)

(58) Field of Classification Search
CPC ..... C07K 14/21; G09G 2300/0842; G09G 2300/0861; G09G 2320/0233; G09G 2320/0247; G09G 2320/064; G09G 2330/021; G09G 3/3233; G09G 3/3258
USPC ..... 345/76–77, 89, 92, 208, 589
See application file for complete search history.

(56) References Cited

U.S. PATENT DOCUMENTS

2007/0146384 A1* 6/2007 Jo ..... G09G 3/20 345/589
2007/0210993 A1* 9/2007 Murakata ..... G09G 3/2022 345/76

(Continued)

FOREIGN PATENT DOCUMENTS

JP 2009-192753 8/2009
JP 2012-53447 3/2012

(Continued)

OTHER PUBLICATIONS

Korean Office Action dated Aug. 21, 2018 in Patent Application No. 10-2017-0131582 (with English translation), citing document AO therein, 10 pages.

*Primary Examiner* — Tony O Davis
(74) *Attorney, Agent, or Firm* — Oblon, McClelland, Maier & Neustadt, L.L.P.

(57) ABSTRACT

An organic EL display device includes a transistor for controlling whether to shut off supply of a current to an organic EL element or not, a pulse signal generation circuit which generates a pulse signal to be inputted to the transistor and a storage unit. The storage unit stores the information in such a way that one frame period includes, in order, a first light emission period which is a period preceding a pulse, a black display period which is a period equivalent to a width of the pulse, and a second light emission period which is longer than the first light emission period, and that an area expressed by a product of a length of and a luminance in a light emission period is greater for the second light emission period than for the first light emission period.

8 Claims, 8 Drawing Sheets

(56) References Cited

U.S. PATENT DOCUMENTS

| | | | | |
|---|---|---|---|---|
| 2007/0296672 | A1* | 12/2007 | Kim | G09G 3/3233 345/92 |
| 2008/0001881 | A1* | 1/2008 | Baba | G09G 3/3406 345/89 |
| 2009/0207193 | A1* | 8/2009 | Isobe | G09G 3/3233 345/690 |
| 2011/0115835 | A1* | 5/2011 | Lee | G09G 3/3233 345/691 |
| 2012/0033000 | A1* | 2/2012 | Takahashi | G09G 3/2025 345/691 |
| 2013/0127929 | A1 | 5/2013 | Isobe et al. | |
| 2013/0234922 | A1* | 9/2013 | Tatsumi | G09G 3/3406 345/102 |
| 2014/0218272 | A1* | 8/2014 | Kikuchi | G09G 3/3258 345/77 |
| 2015/0054815 | A1* | 2/2015 | Toyoda | G09G 3/3233 345/212 |
| 2015/0187268 | A1* | 7/2015 | Tani | G09G 3/3233 345/77 |
| 2015/0371589 | A1* | 12/2015 | Kim | G09G 3/3258 345/208 |
| 2016/0284272 | A1* | 9/2016 | Her | G09G 3/3233 |
| 2017/0330509 | A1* | 11/2017 | Cok | G09G 3/2014 |
| 2018/0075801 | A1* | 3/2018 | Le | G09G 3/3233 |

FOREIGN PATENT DOCUMENTS

| | | |
|---|---|---|
| JP | 2013-186255 | 9/2013 |
| KR | 10-2009-0086319 A | 8/2009 |

* cited by examiner

ORGANIC EL DISPLAY DEVICE AND METHOD OF DRIVING AN ORGANIC EL DISPLAY DEVICE

CROSS-REFERENCE TO RELATED APPLICATION

The present application claims priority from the Japanese Application JP2016-201585 filed on Oct. 13, 2016, the content of which is hereby incorporated by reference into this application.

BACK GROUND OF THE INVENTION

1. Field of the Invention

The present invention relates to an organic EL display device and a method of driving an organic EL display device.

2. Description of the Related Art

Recently, with respect to an organic EL display device using an organic EL (electroluminescent) element, the development of technology to reduce flickering has been underway in order to improve display quality.

For example, JP2012-53447A discloses a driving method in which light emitting elements of pixels are made to emit light intermittently during a light emission period for one frame and in which the luminance during each light emission period is gradually lowered, thus reducing flickering.

JP2009-192753A discloses that a light emission mode is determined based on an average luminance level of an entire screen and that the number of lighting periods arranged within one frame period, the arrangement position and the period length are set according to setting conditions prescribed for each determined light emission mode, thus reducing flickering.

JP2013-186255A discloses that a period when a backlight is made to emit light with high luminance and a period when the backlight is made to emit light longer than that period and with lower luminance are provided within a period when image data of one frame is displayed on a liquid crystal panel.

SUMMARY OF THE INVENTION

In an organic EL display device with a high frame frequency, flickering is reduced by the methods described in JP2012-53447A, JP2009-192753A and JP2013-186255A. However, if the frame frequency is lowered in order to reduce power consumption, flickering occurs even in organic EL display devices using these methods. For example, an organic EL display device which operates in response to an input of a 60-Hz vireo signal is commonly used. If this organic EL display device is driven at 30 Hz, human eyes perceive flickering.

A change in luminance with time will be described referring to FIGS. 8A and 8B. FIG. 8A shows a change in luminance with time in the case where an organic EL display device which is normally driven at 60 Hz is driven at 30 Hz by a conventional driving method for reducing flickering.

If the display device is driven at 60 Hz, the length of one frame period is 16.7 ms. Meanwhile, if the display device is driven at 30 Hz, the length of one frame period is 33.3 ms.

As shown in FIG. 8A, the luminance of the organic EL display device is at its highest at the start of one frame period and gradually decreases toward the end of the one frame period. Therefore, if the display device which is normally driven at 60 Hz is driven at 30 Hz, the luminance changes greatly at the time of switching from one frame to another and therefore flickering occurs.

Thus, conventionally, a black display period is provided in the former half of one frame period in order to reduce flickering. Also, a black display period is provided so that areas expressed by the products of the luminance and the light emission period in the former half and latter half of one frame period are the same. Here, the length of the black display period is set in such a way that a product S1 of the luminance and the light emission period in the former half of one frame period is the same as a product S2 of the luminance and the light emission period in the latter half of one frame period.

Similarly, FIG. 8B shows a change in luminance with time in the case where an organic EL display device which is normally driven at 60 Hz is driven at 30 Hz by a conventional driving method for reducing flickering. The driving method shown in FIG. 8B differs from the driving method shown in FIG. 8A in that five light emission periods are provided in each of the former half and latter half of one frame period.

In the driving method shown in FIG. 8B, too, the length of the black display period provided between the individual light emission periods is set in such a way that the total of areas S1*a* to S1*e* expressed by the products of the light emission period and the luminance in the former half of one frame period is equal to the total of areas S2*a* to S2*e* expressed by the products of the light emission period and the luminance in the latter half of one frame period.

With the driving methods as shown in FIGS. 8A and 8B, the area expressed by the product of the light emission period and the luminance in the former half of one frame period is equal to the area expressed by the product of the light emission period and the luminance in the latter half. However, the inventors have found that flickering cannot be completely restrained even if these areas are made equal in the organic EL display device.

In view of the foregoing problems, an object of the invention is to provide an organic EL display device which consumes less electricity by being driven at a low frequency and which achieves high display quality with reduced flickering.

According to one aspect of the present invention, an organic EL display device includes a display panel including a plurality of pixels, each having an organic EL element, and a transistor for controlling whether to shut off supply of a current to the organic EL element or not, a pulse signal generation circuit which generates a pulse signal to be inputted to the transistor, and a storage unit which stores information about setting of a timing and pulse width of the pulse signal. The storage unit stores the information in such a way that one frame period includes, in order, a first light emission period which is a period preceding a pulse, a black display period which is a period equivalent to a width of the pulse, and a second light emission period which is longer than the first light emission period, and that an area expressed by a product of a length of and a luminance in a light emission period is greater for the second light emission period than for the first light emission period.

In one embodiment of the present invention, the storage unit further includes a unit which stores the information in such a way that a third light emission period with the same length as the first light emission period is provided between the black display period and the second light emission period.

In one embodiment of the present invention, the storage unit further includes a unit which stores the information in such a way that a third light emission period which is longer than the first light emission period and shorter than the second light emission period is provided between the black display period and the second light emission period.

In one embodiment of the present invention, the storage unit further includes a unit which stores the information in such a way that a plurality of the third light emission periods is provided and that the plurality of third light emission periods gradually becomes longer as it goes from the first light emission period toward the second light emission period.

In one embodiment of the present invention, the storage unit further includes a unit which stores the information about a number of the black display periods inserted in the one frame period.

In one embodiment of the present invention, the luminance of each of the plurality of pixels gradually drops during the one frame period.

According to another aspect of the present invention, there is provided a method of driving an organic EL display device, the organic EL display device including a plurality of pixels, each having an organic EL element. The method includes a first light emission period, a black display period, and a second light emission period, in order in one frame period. Each of the pixels emits light with a luminance corresponding to a video signal inputted thereto during the first light emission period, displays a black image during the black display period, and emits light during the second light emission period with a lower luminance than in the first light emission period. The first light emission period is shorter than the second light emission period, and an area expressed by a product of a length of and a luminance in alight emission period is greater for the second light emission period than for the first light emission period.

In one embodiment of the present invention, the luminance of each of the plurality of pixels gradually drops during the one frame period.

DETAILED DESCRIPTION OF THE INVENTION

Figure 1:
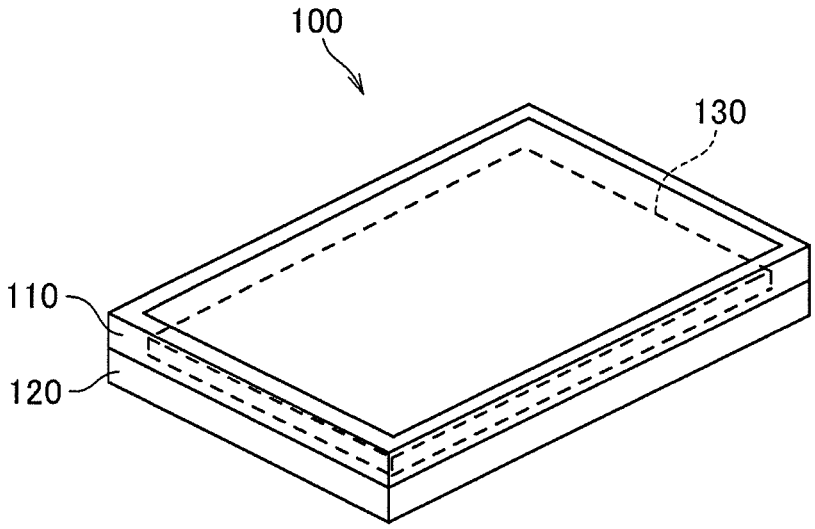
FIG. 1 schematically shows a display device according to an embodiment of the invention.

Hereinafter, each embodiment of the invention will be described, referring to the drawings. In order to clarify the description, the drawings may schematically show each part in terms of width, thickness, shape and the like, compared with its actual configuration. However, this is simply an example and should not limit the interpretation of the invention. Moreover, in the specification and drawings, elements similar to those described with reference to already described drawings are denoted by the same reference signs and detailed description of these elements may be omitted where appropriate.

FIG. 1 schematically shows a display device 100 according to an embodiment of the invention. As illustrated, the display device 100 is configured of a display module 130 fixed in such a way as to be sandwiched by an upper frame 110 and a lower frame 120.

Figure 2:
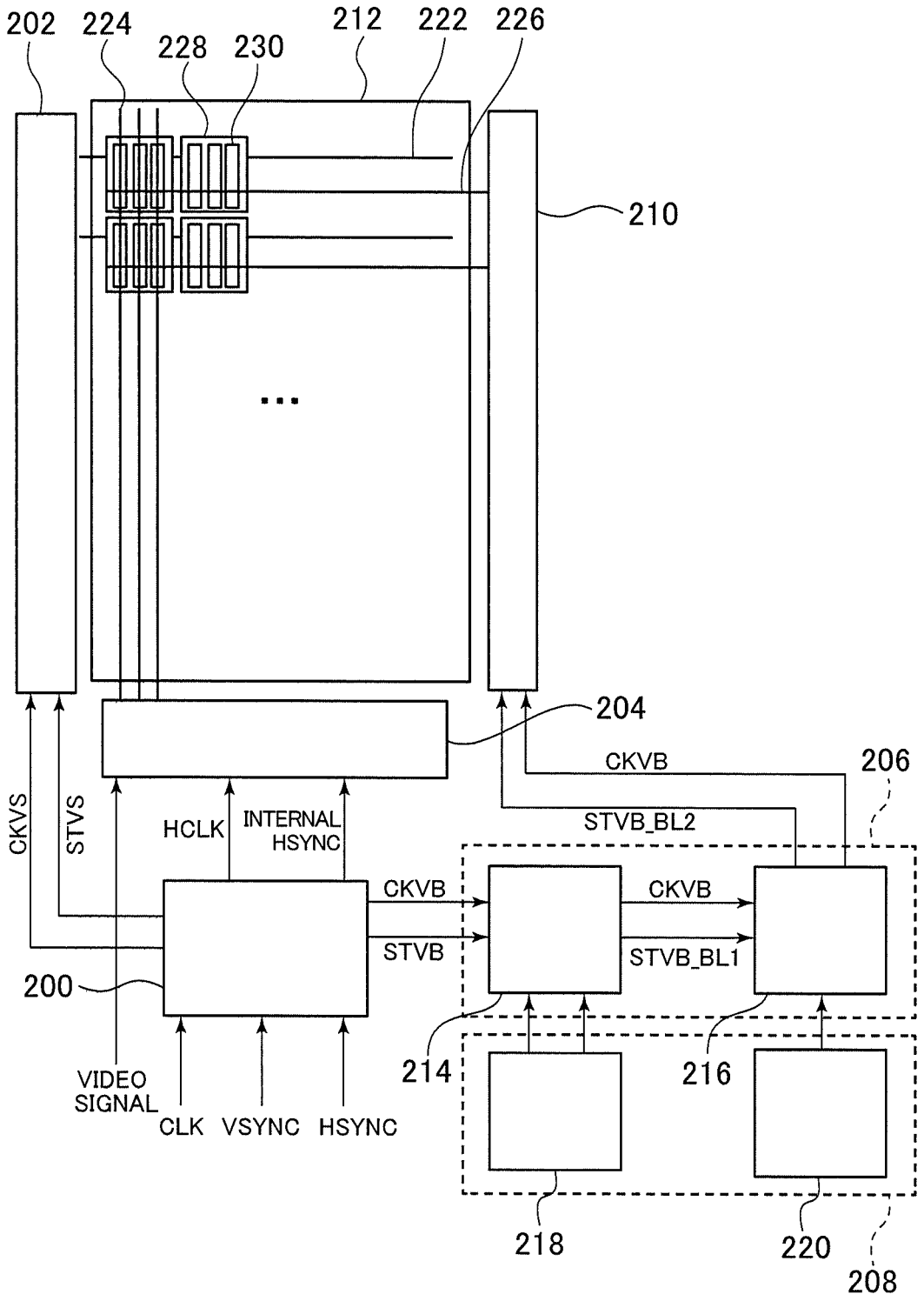
FIG. 2 illustrates the functional configuration of a display module.

FIG. 2 illustrates the functional configuration of the display module 130 shown in FIG. 1. As shown in FIG. 2, the display module 130 has a timing control circuit 200, a signal gate circuit 202, a source circuit 204, a pulse signal generation circuit 206, a storage unit 208, an EL gate circuit 210, and a display panel 212.

The timing control circuit 200 acquires a clock signal (CLK), a vertical synchronization signal (VSYNC) and a horizontal synchronization signal (HSYNC) from a device which supplies a video signal to the display module 130. The timing control circuit 200 also generates a gate clock signal (CKVS) and a gate start signal (STVS), based on the acquired signals, and outputs the generated signals to the signal gate circuit 202. The timing control circuit 200 also generates a source clock signal (HCLK) and a horizontal synchronization signal (internal HSYNC) for the source circuit 204, based on the acquired signals, and outputs the generated signals to the source circuit 204. The timing control circuit 200 also generates a black insertion clock signal (CKVB) and a black insertion start signal (STVB), based on the acquired signals, and outputs the generated signals to the pulse signal generation circuit 206. The black insertion clock signal and the black insertion start signal will be described later.

The signal gate circuit 202 controls the timing of feeding a current to each organic EL element 310, described later. Specifically, the signal gate circuit 202 generates a gate signal for controlling the timing of feeding a current to the organic EL element 310, based on the gate clock signal and the gate start signal, and supplies the gate signal to a gate signal line 222, described later.

The source circuit 204 controls the magnitude of the current fed to each organic EL element 310. Specifically, the source circuit 204 acquires a video signal from a device which supplies a video signal to the display module 130. The source circuit 204 also supplies a voltage corresponding to the video signal to each pixel 228, to a video signal line 224, described later, based on the source clock signal and the horizontal synchronization signal for the source circuit 204 acquired from the timing control circuit 200, and the video signal.

The pulse signal generation circuit 206 generates a pulse signal to be inputted to a black insertion transistor 312, described later. Specifically, the pulse signal generation circuit 206 includes a black insertion correction circuit 214 and a black insertion generation circuit 216.

The black insertion correction circuit 214 generates a first black insertion start signal (STVB_BL1), based on the black insertion clock signal and the black insertion start signal acquired from the timing control circuit 200, and information stored in the storage unit 208. The black insertion correction circuit 214 also supplies the black insertion clock signal acquired from the timing control circuit 200, directly to the black insertion generation circuit 216.

The black insertion generation circuit 216 generates a second black insertion start signal (STVB_BL2), based on the first black insertion start signal and the information stored in the storage unit 208. The black insertion generation circuit 216 also supplies the black insertion clock signal acquired from the black insertion correction circuit 214, directly to the EL gate circuit 210. The first black insertion start signal and the second black insertion start signal will be described later.

The storage unit 208 stores information about the setting of the timing and pulse width of a pulse signal. Specifically, for example, the storage unit 208 stores the information in such a way that one frame period includes, in order, a first light emission period which is a period preceding a pulse of a black insertion signal, a black display period which is a period equivalent to the width of the pulse, and a second light emission period which is longer than the first light emission period, and that the area expressed by the product of the length of and the luminance in the light emission period is greater for the second light emission period than for the first light emission period. The first light emission period, the second light emission period and the black display period will be described later.

The storage unit 208 is, for example, a memory formed of a non-volatile memory or the like. Specifically, the storage unit 208 includes a period width memory 218 and a correction memory 220.

The period width memory 218 stores information about the setting of the timing and pulse width used when the pulse signal generation circuit 206 generates a pulse signal. Specifically, the period width memory 218 stores that the period from the start of one frame period to the black insertion period or the pulse width is a period t1.

The period width memory 218 may also store information about the number of black display periods inserted during one frame period. For example, the period width memory 218 stores information that ten black insertion periods are provided in one frame period.

The correction memory 220 stores information about the setting of the length of the black insertion period included in one frame period. Specifically, for example, if a plurality of black insertion periods is provided in one frame period, the correction memory 220 stores information indicating whether to gradually shorten each black insertion period or not.

The EL gate circuit 210 controls the timing of shutting off the current fed to each organic EL element 310. Specifically, the EL gate circuit 210 generates a black insertion signal for controlling the timing of shutting off the current fed to the organic EL element 310, based on the black insertion clock signal and the second black insertion start signal, and supplies the black insertion signal to a black insertion gate signal line 226, described later.

The display panel 212 includes the plurality of pixels 228, the gate signal line 222, the video signal line 224, and the black insertion gate signal line 226. Each of the plurality of pixels 228 includes a plurality of subpixels 230 emitting light in different colors from each other. The gate signal line 222, the video signal line 224 and the black insertion gate signal line 226 will be described, referring to FIG. 3.

Figure 3:
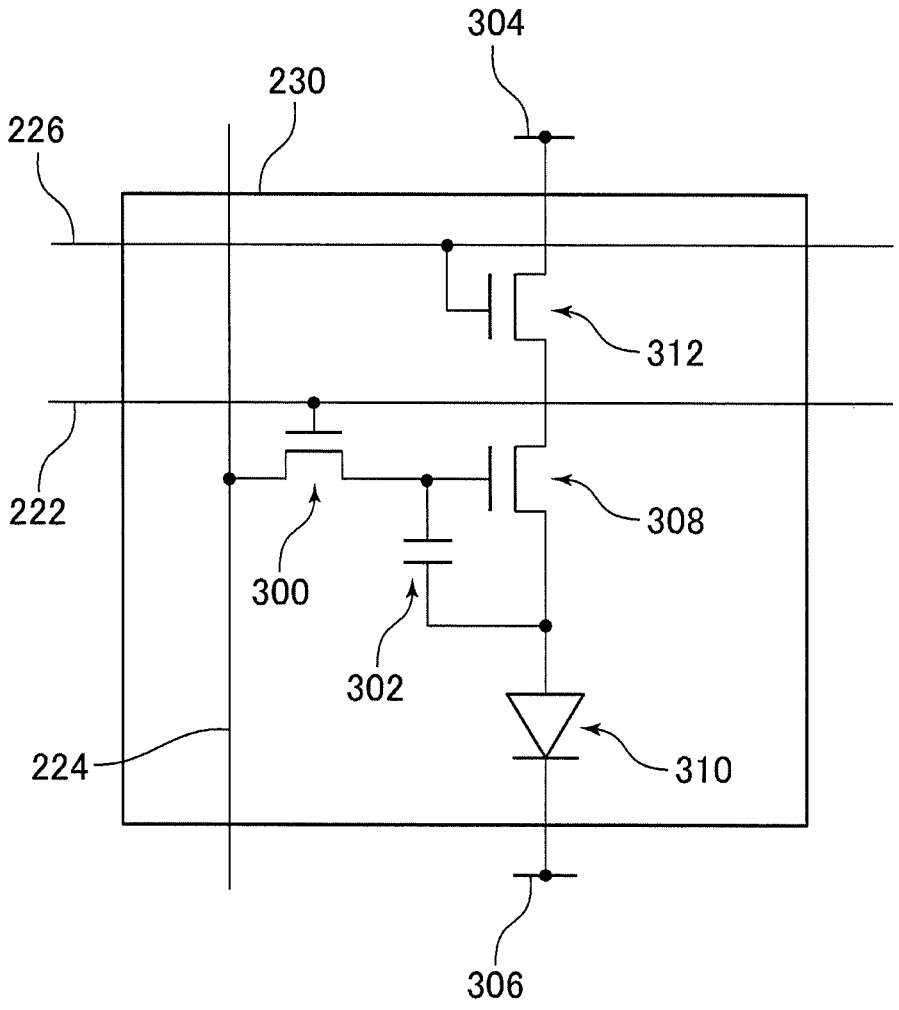
FIG. 3 is an example schematically showing a subpixel circuit.

FIG. 3 is an example schematically showing a circuit formed in one subpixel 230. As shown in FIG. 3, the circuit formed in the subpixel 230 includes the gate signal line 222, the video signal line 224, the black insertion gate signal line 226, a pixel selection transistor 300, a capacitor 302, a power supply 304, a cathode electrode 306, a drive transistor 308, the organic EL element 310, and the black insertion transistor 312.

The gate signal line 222 is connected to the gate terminal of the pixel selection transistor 300. Specifically, the gate signal line 222 electrically connects the signal gate circuit 202 to the gate terminal of the pixel selection transistor 300, and supplies the gate signal acquired from the signal gate circuit 202 to the gate terminal of the pixel selection transistor 300.

The video signal line 224 is connected to one of the source terminal and the drain terminal of the pixel selection transistor 300. Specifically, the video signal line 224 electrically connects the source circuit 204 to one of the source terminal and the drain terminal of the pixel selection transistor 300, and supplies a voltage corresponding to the video signal acquired from the source circuit 204 to one of the source terminal and the drain terminal of the pixel selection transistor 300.

The black insertion gate signal line 226 is connected to the gate terminal of the black insertion transistor 312. Specifically, the black insertion gate signal line 226 electrically connects the EL gate circuit 210 to the gate terminal of the black insertion transistor 312, and supplies the black insertion signal acquired from the EL gate circuit 210 to the gate terminal of the black insertion transistor 312.

The pixel selection transistor 300 controls the timing of supplying a video signal voltage to the drive transistor 308. Specifically, the source terminal and the drain terminal of the pixel selection transistor 300 become electrically continuous (hereinafter referred to as ON-state) in the state where the voltage applied to the gate terminal is either in a high-state or in a low-state. The pixel selection transistor 300 supplies the voltage of the video signal line 224 to the capacitor 302 according to the state of the gate signal supplied to the gate terminal, and thus controls the timing of supplying the video signal voltage to the drive transistor 308.

The capacitor 302 holds the voltage supplied from the video signal line 224. Specifically, the capacitor 302 has the same potential as the voltage of the video signal line 224 at the timing when the pixel selection transistor 300 is in the ON-state. Subsequently, based on the gate signal, the source terminal and the drain terminal of the pixel selection transistor 300 shift to the state of being electrically shut off (hereinafter referred to as OFF-state). The capacitor 302 is in a floating state until the next time the pixel selection transistor 300 shifts to the ON-state. Therefore, the capacitor 302 holds the voltage supplied from the video signal line 224.

Here, when the pixel selection transistor 300 is in the OFF-state, the supplied voltage gradually drops. Specifically, even when the pixel selection transistor 300 is in the OFF-state, there is a leakage current or the like and therefore the voltage held by the capacitor 302 gradually drops.

Specifically, the pixel selection transistor 300 shifts to the ON-state once during one frame period. Therefore, ideally, the capacitor 302 should hold the voltage supplied when the pixel selection transistor 300 is in the ON-state, for one frame period. However, due to a leakage current or the like, the voltage of the capacitor 302 gradually drops. Thus, since the amount of light emission of the organic EL element 310 is decided by the voltage of the capacitor 302, the luminance of each subpixel 230 gradually drops during one frame period.

The power supply 304 is connected to the black insertion transistor 312 and supplies a current to the organic EL element 310. Specifically, the power supply 304 is electrically connected to the source terminal or the drain terminal of the black insertion transistor 312. Since a constant voltage is applied to the power supply 304, the power supply 304 supplies a current to the organic EL element 310 when the drive transistor 308 and the black insertion transistor 312 are in the ON-state.

The cathode electrode 306 is electrically connected to the organic EL element 310. Specifically, the cathode electrode 306 is electrically connected to the cathode terminal of the organic EL element 310. By having a voltage applied from the power supply 304, the cathode electrode 306 supplies a current to the organic EL element 310.

The drive transistor 308 is connected to the pixel selection transistor 300, the capacitor 302, the black insertion transistor 312, and the organic EL element 310. Specifically, the gate terminal of the drive transistor 308 is electrically connected to the source terminal or the drain terminal of the pixel selection transistor 300 and to the capacitor 302. One of the source terminal and the drain terminal of the drive transistor 308 is electrically connected to the source terminal or the drain terminal of the black insertion transistor 312. The other one of the source terminal and the drain terminal of the drive transistor 308 is electrically connected to the capacitor 302 and to the anode terminal of the organic EL element 310.

The drive transistor 308 also supplies a current to the organic EL element 310. Specifically, according to the voltage applied to the capacitor 302, the drive transistor 308 supplies the current supplied from the power supply 304, to the organic EL element 310.

The organic EL element 310 emits light with its luminance gradually dropping during one frame period. That is, the luminance of each of the plurality of pixels 228 gradually drops during one frame period. Specifically, the organic EL element 310 is supplied with a current corresponding to the voltage held by the capacitor 302, from the drive transistor 308. As described above, the voltage held by the capacitor 302 gradually drops during one frame period. Therefore, the organic EL element 310 emits light with its luminance gradually dropping during one frame period.

The black insertion transistor 312 controls whether to shut off the supply of the current or the supply of electricity to the organic EL element 310 from the power supply, or not. Specifically, one of the source terminal and the drain terminal of the black insertion transistor 312 is connected to the power supply 304. The other one is electrically connected to the source terminal or the drain terminal of the drive transistor 308. The gate terminal of the drive transistor 308 is electrically connected to the black insertion gate signal line 226.

The black insertion transistor 312 is controlled to be in the ON-state or OFF-state by the black insertion signal supplied from the black insertion gate signal line 226. When the black insertion transistor 312 is in the ON-state, the black insertion transistor 312 supplies the current supplied from the power supply 304, to the organic EL element 310 via the drive transistor 308. Meanwhile, when the black insertion transistor 312 is in the OFF-state, the black insertion transistor 312 shuts off the supply of the current to the organic EL element 310.

Next, the driving method for the display device 100 according to the invention will be described. The driving method according to the invention is a method of driving an organic EL display device configured of the plurality of pixels 228 having the organic EL element 310 which emits light with its luminance gradually dropping during one frame period as described above. One frame period includes a first light emission period, a black display period, and a second light emission period.

A specific driving method will be described, referring to FIGS. 4 and 5. In this embodiment, the driving method for the display device 100 includes a normal mode in which the display device is driven at a frame frequency of 60 Hz and a power-saving mode in which the display device is driven at a frame frequency of 30 Hz.

Figure 4:
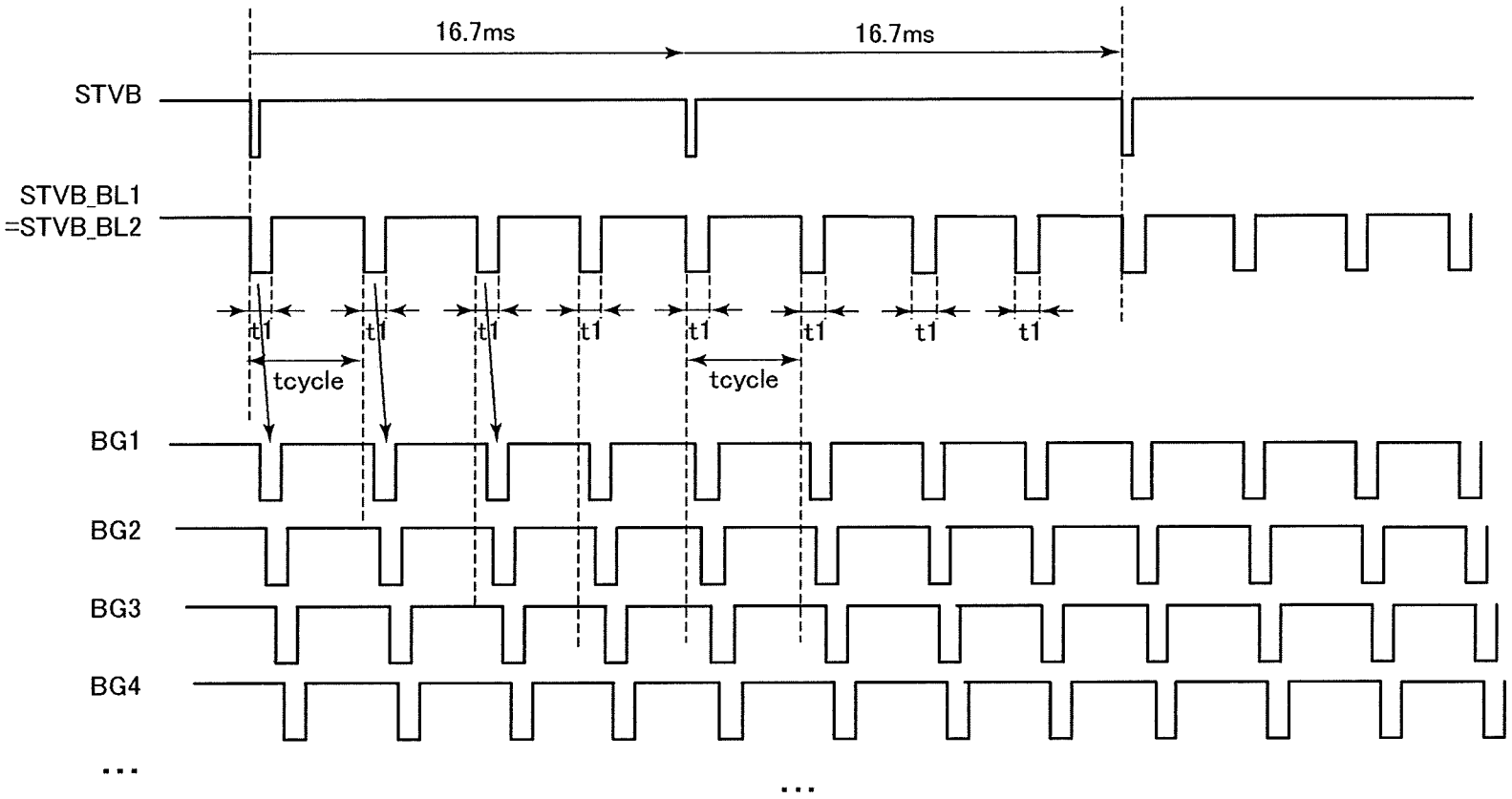
FIG. 4 is a timing chart in the case where 60-Hz driving is carried out.

FIG. 4 shows a timing chart of a gate start signal, a first black insertion start signal, a second black insertion start signal, and a black insertion signal in the normal mode.

The gate start signal is in a low-state for a predetermined period at the beginning of one frame period and is in a high-state for the rest of one frame period (16.7 ms).

The first black insertion start signal is in a low-state for a period t1 at the beginning of a period tcycle and is in a high-state for the rest of the period tcycle shown in FIG. 4. The first black insertion start signal includes four tcycle periods in one frame period.

The period t1 and the number of tcycle periods included in the first black insertion start signal are set by the information stored in the period width memory 218.

The second black insertion start signal, in the normal mode, is the same signal as the first black insertion start signal. In the normal mode, the correction memory 220 stores information such that the second black insertion start signal that is the same as the first black insertion start signal is generated.

The black insertion signal is a signal resulting from shifting the second black insertion start signal by one horizontal period for each line of pixels 228 formed in the display panel 212. Specifically, BGn shown in FIG. 4 is the black insertion signal supplied to the black insertion gate signal line 226 arranged in the n-th line in the display panel 212. As shown in FIG. 4, BG1 supplied to the black insertion gate signal line 226 arranged in the first line is a signal resulting from shifting the second black insertion start signal.

Also, as shown in FIG. 4, BG2 as the black insertion signal supplied to the black insertion gate signal line 226 arranged in the second line is a signal resulting from shifting BG1 by one horizontal period. Similarly, the signals BG3 onward are signals resulting from shifting, by one horizontal period, the black insertion signal supplied to the black insertion gate signal line 226 one line above.

As described above, since the black insertion signal becomes a low-signal four times during one horizontal period, the display device 100 performs black display four times during one horizontal period.

Next, each signal in the power-saving mode will be described. FIG. 5 shows a timing chart of a gate start signal, a first black insertion start signal, a second black insertion start signal, and a black insertion signal in the power-saving mode.

The gate start signal is in a low-state at the beginning of one frame period and is in a high-state for the rest of one frame period (33.3 ms).

Figure 5:
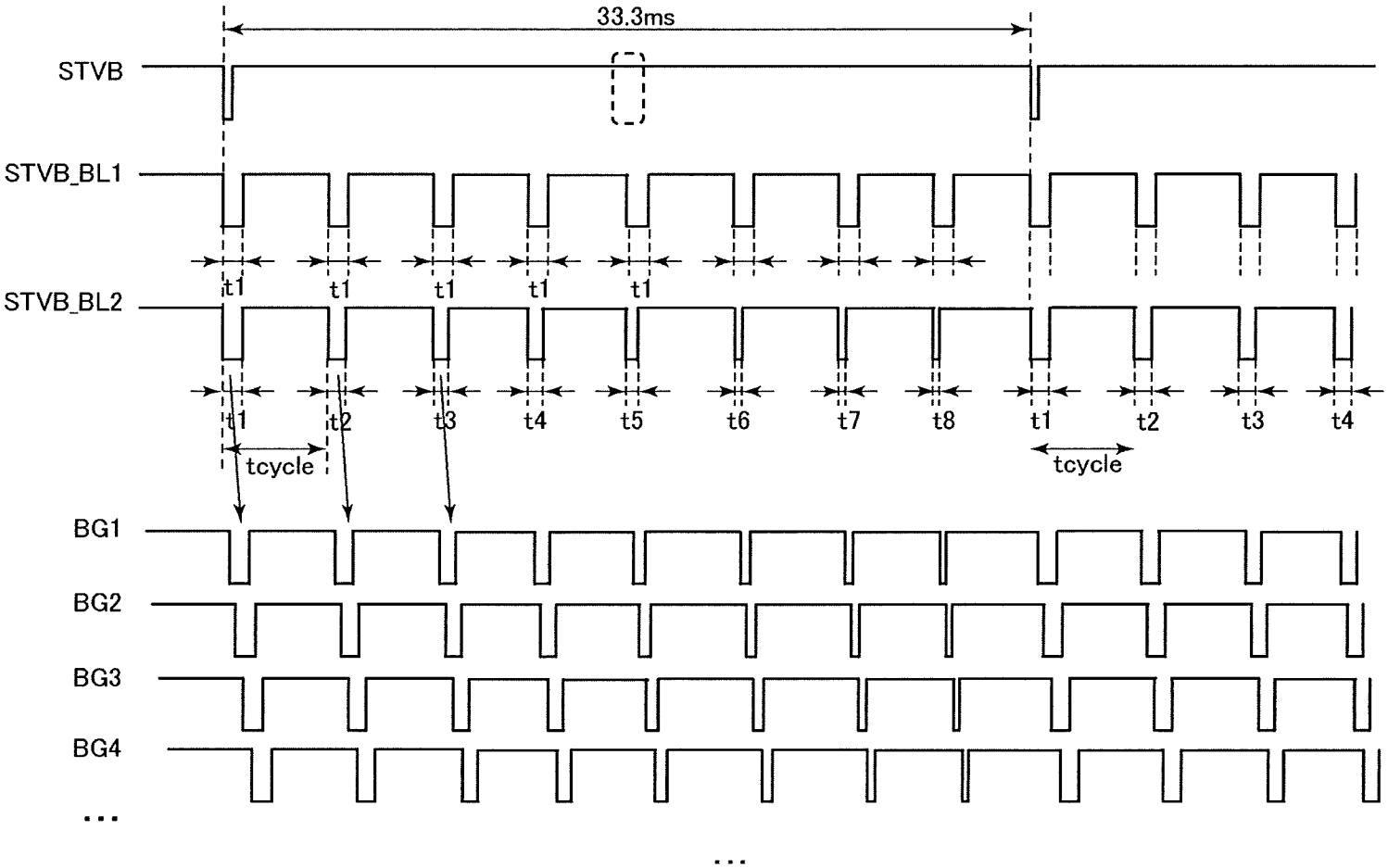
FIG. 5 is a timing chart in the case where 30-Hz driving is carried out.

The first black insertion start signal is in a low-state for a period t1 at the beginning of the a period tcycle and is in a high-state for the rest of the period tcycle shown in FIG. 5. The first black insertion start signal includes eight tcycle periods in one frame period.

In the power-saving mode, the second black insertion start signal is a signal in which the pulse width included in the first black insertion start signal is gradually reduced within one frame period. Specifically, the first black insertion start signal includes eight pulses, each having a width t1, in one frame period. In contrast, the second black insertion start signal includes pulses having widths t1 to t8 in order, in one frame period. The widths t1 to t8 become shorter in this order.

The second black insertion start signal is generated, based on the storage unit 208 storing information in such a way that a plurality of light emission periods are provided between the black display period and the second light emission period and that the plurality of light emission periods become gradually longer as it goes from the first light emission period toward the second light emission period.

The black insertion signal is a signal resulting from shifting the second black insertion start signal by one horizontal period for each line of the pixels 228 formed in a matrix, as in the case of the normal mode. Specifically, BG1 shown in FIG. 5 is a signal resulting from shifting the second black insertion start signal. The signals BG2 onward are signals resulting from shifting, by one horizontal period, the black insertion signal supplied to the black insertion gate signal line 226 one line above.

The pulse widths included in the second black insertion start signal become gradually shorter within one frame period. However, all of the pulse widths included in one frame period may be the same, or only the last pulse width in one frame period may be shorter.

As described above, the black insertion signal becomes a low-signal eight times during one horizontal period. Therefore, the display device 100 performs black display eight times during one horizontal period. Specifically, black display will be described, for example, referring to FIG. 6. As shown in the left part of FIG. 6, in the state where n horizontal periods have passed from the start of one frame period, black is displayed in eight strip-shaped areas on the display device 100. Meanwhile, as shown in the right part of FIG. 6, in the state where n+1 horizontal periods have passed from the start of one frame period, black is displayed in eight strip-shaped areas shifted below by one line on the display device 100.

Figure 6:
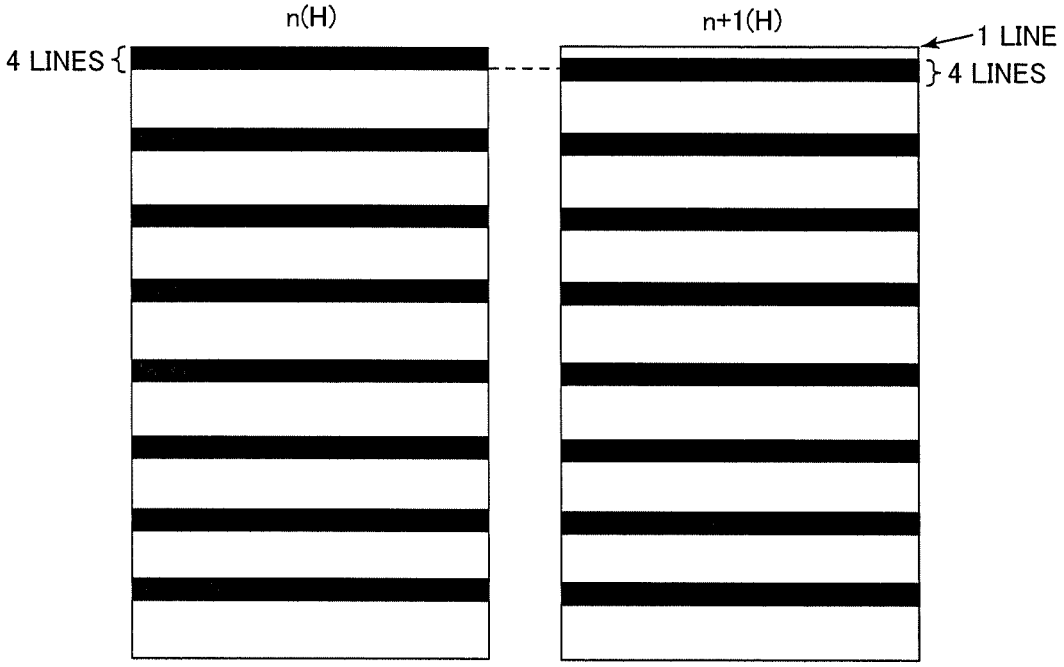
FIG. 6 is a illustrate for describing black display.

The width of a black display area corresponds to the pulse width of the black insertion signal. In FIG. 6, all of the black display areas have a width of four lines. However, the widths of the black display areas may correspond to the lengths of t1 to t8 shown in FIG. 5.

Figure 7:
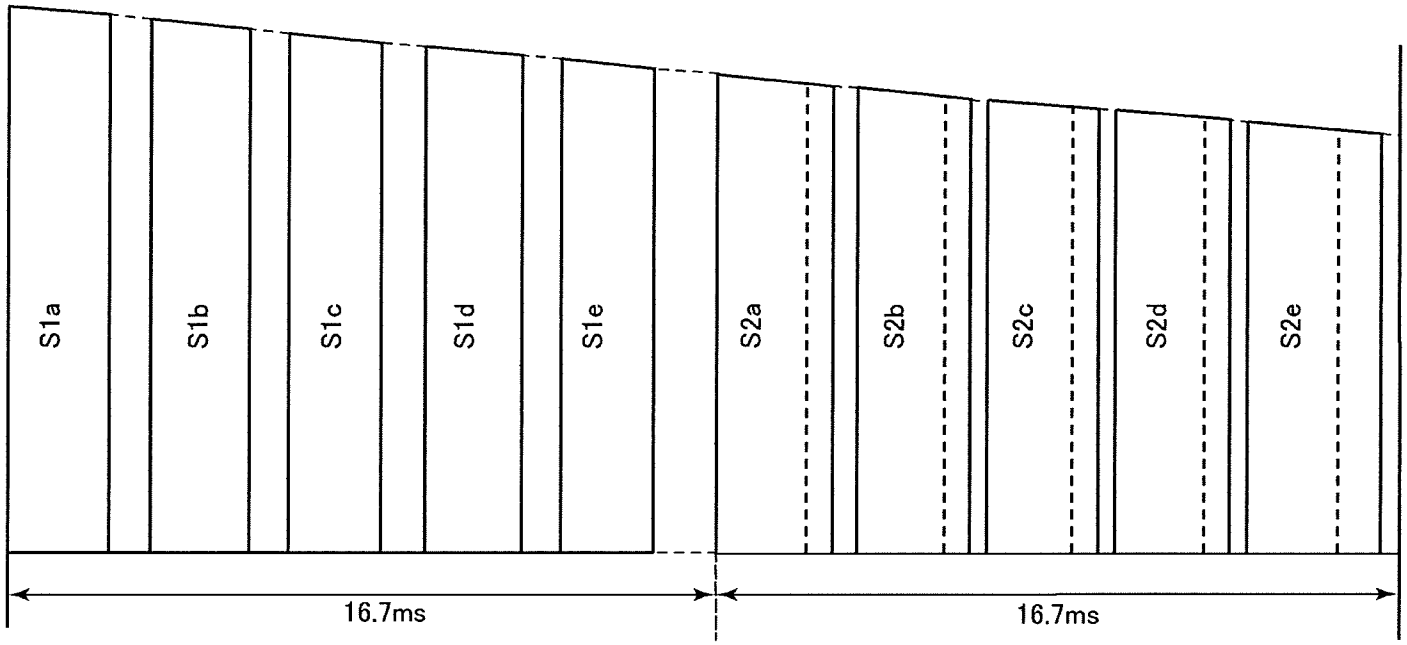
FIG. 7 illustrates a change in luminance with time in the embodiment of the invention.
Figure 8A:
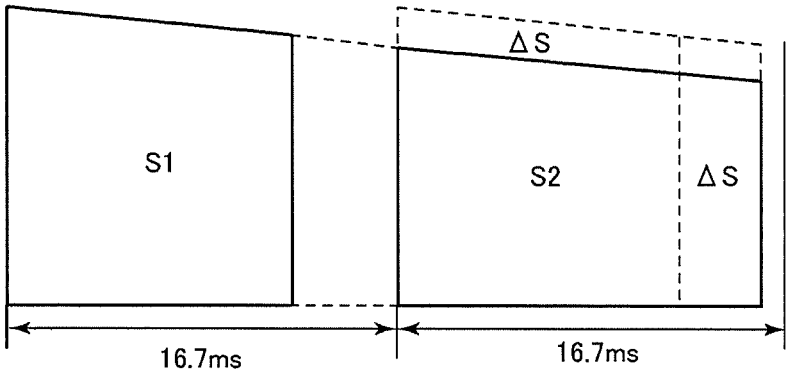
FIGS. 8A and 8B illustrate a change in luminance with time according to conventional techniques.
Figure 8B:
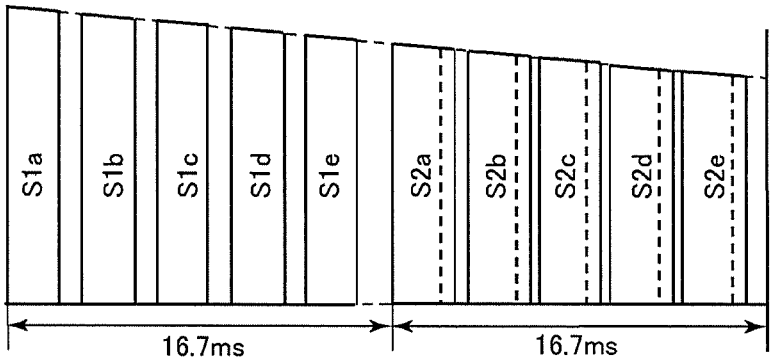

Next, a change in luminance with time in the power-saving mode will be described, referring to FIG. 7. As shown in FIG. 7, ten light emission periods are provided in one frame period. Here, the area expressed by the product of the length of each light emission period included in one frame period and the luminance in the light emission period is denoted by S1*a*, to S1*e* and S2*a* to S2*e* in order. The light emission period with the area S1*a* is referred to as a first light emission period. The light emission period with the area S2*e* is referred to as a second light emission period. The other light emission periods are referred to as third light emission periods.

As shown in FIG. 7, the organic EL element 310 emits light with its luminance gradually dropping during one frame period. Therefore, the luminance in each light emission period gradually drops from the first light emission period to the second light emission period.

In the invention, each pixel 228 emits light with a luminance corresponding to a video signal inputted thereto during the first light emission period, displays a black image during the black display period, and emits light during the second light emission period with a lower luminance than in the first light emission period. Here, the storage unit 208 stores information in such a way that the area expressed by the product of the length of and the luminance in the light emission period is greater for the second light emission period than for the first light emission period. Therefore, the area S2*e* is greater than S1*a* in FIG. 7.

The storage unit 208 may also include a unit which stores information in such a way that a third light emission period with the same length as the first light emission period is provided between the black display period and the second light emission period, or may include a unit which stores information in such a way that a third light emission period is not provided.

Specifically, each of the areas S1*b* to S2*d* may be the same as S1*a*. In this case, the storage unit 208 stores information in such a way that third light emission periods with the same length as the first light emission period are provided between the black display period and the second light emission period. While eight third light emission periods are provided in FIG. 7, it suffices that at least the first light emission period and the second light emission period are provided, and therefore a configuration without a third light emission period may be employed.

Also, the storage unit 208 may include a unit which stores information in such a way that a third light emission period which is longer than the first light emission period and shorter than the second light emission period is provided between the black display period and the second light emission period. Specifically, the storage unit 208 may include a unit which stores information in such a way that a plurality of third light emission periods is provided between the black display period and the second light emission period and that the plurality of third light emission periods gradually becomes longer as it goes from the first light emission period toward the second light emission period.

For example, as shown in FIG. 7, each of the areas S1*b* to S2*d* may be greater than the area S1*a* and smaller than the area S2*e*. In this case, the areas S1*b* to S2*d* may gradually increase as it approaches the second light emission period.

As described above, with the driving method in which the area of the second light emission period is greater than the area of the first light emission period, flickering perceived by human eyes is reduced.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An organic EL display device comprising:

a display panel including a plurality of pixels, each having an organic EL element, and a transistor for controlling whether to shut off supply of a current to the organic EL element or not;

a pulse signal generation circuit which generates a pulse signal to be inputted to the transistor; and a storage which stores information about setting of a timing and pulse width of the pulse signal;

wherein the storage stores the information in such a way that one frame period includes, in order, a first light emission period which is a period preceding a pulse, a black display period which is a period equivalent to a width of the pulse, and a second light emission period which is longer than the first light emission period, and that a second area expressed by a product of the second light emission period and a second luminance in the second light emission period is greater than a first area expressed by a product of the first light emission period and a first luminance in the first light emission period.

2. The organic EL display device according to claim 1, wherein the storage further includes a unit which stores the information in such a way that a third light emission period with the same length as the first light emission period is provided between the black display period and the second light emission period.

3. The organic EL display device according to claim 1, wherein the storage further includes a unit which stores the information in such a way that a third light emission period which is longer than the first light emission period and shorter than the second light emission period is provided between the black display period and the second light emission period.

4. The organic EL display device according to claim 3, wherein the storage further includes a unit which stores the information in such a way that a plurality of the third light emission periods is provided and that the plurality of third light emission periods gradually becomes longer as the third light emission periods go from the first light emission period toward the second light emission period.

5. The organic EL display device according to claim 1, wherein the storage further includes a unit which stores the information about a number of black display periods inserted in the one frame period.

6. The organic EL display device according to claim 1, wherein luminance of each of the plurality of pixels gradually drops during the one frame period.

7. A method of driving an organic EL display device, the organic EL display device including a plurality of pixels, each having an organic EL element, the method comprising a first light emission period, a black display period, and a second light emission period, in order in one frame period, wherein each of the pixels emits light with a luminance corresponding to a video signal inputted thereto during the first light emission period, displays a black image during the black display period, and emits light with a second luminance in the second light emission period being lower than a first luminance in the first light emission period, and the first light emission period is shorter than the second light emission period, and a second area expressed by a product of the second light emission period and the second luminance is greater than a first area expressed by a product of the first light emission period and the first luminance.

8. The method of driving the organic EL display device according to claim 7, wherein the luminance of each of the plurality of pixels gradually drops during the one frame period.

* * * * *